US007712460B2

(12) United States Patent
Simo et al.

(10) Patent No.: US 7,712,460 B2
(45) Date of Patent: May 11, 2010

(54) RELEASE DEVICE WITH FOLLOW-THROUGH

(75) Inventors: Miroslav A. Simo, Riverside, IL (US); Gregory C. Smith, Geneva, IL (US)

(73) Assignee: New Archery Products Corp., Forest Park, IL (US)

( * ) Notice: Subject to any disclaimer, the term of this patent is extended or adjusted under 35 U.S.C. 154(b) by 220 days.

(21) Appl. No.: 11/820,486

(22) Filed: Jun. 19, 2007

(65) Prior Publication Data

US 2008/0314373 A1 Dec. 25, 2008

(51) Int. Cl.
*F41B 5/18* (2006.01)

(52) U.S. Cl. ..... 124/35.2

(58) Field of Classification Search ..... 124/35.2
See application file for complete search history.

(56) References Cited

U.S. PATENT DOCUMENTS

| | | | |
|---|---|---|---|
| 4,674,469 | A | 6/1987 | Peck |
| 4,860,720 | A | 8/1989 | Todd |
| 4,949,698 | A | 8/1990 | Burnham |
| 5,307,788 | A | 5/1994 | Peck |
| 5,370,102 | A | 12/1994 | Peck |
| 5,417,197 | A | 5/1995 | Bankstahl |
| 5,564,407 | A | 10/1996 | Linsmeyer |
| 5,582,158 | A | 12/1996 | Linsmeyer |
| 6,481,430 | B1 | 11/2002 | Lightcap, Jr. |
| 6,484,710 | B1 | 11/2002 | Summers et al. |
| 6,925,995 | B1 | 8/2005 | McConnell et al. |
| RE38,833 | E | 10/2005 | Linsmeyer |
| 6,968,836 | B1 | 11/2005 | Kees |
| 2003/0019488 | A1 | 1/2003 | Eckert et al. |
| 2006/0048762 | A1 | 3/2006 | Mitchell et al. |

*Primary Examiner*—John Ricci
(74) *Attorney, Agent, or Firm*—Pauley Petersen & Erickson

(57) ABSTRACT

A release device with a follow-through or recoil motion for use with mechanically launched projectiles. A recoil motion is in a direction opposite the path of the projectile. Releasing an arrow from a bow provides correct form and follow-through motion of a user hand directly opposite to a direction of a path of the launched arrow, to improve flight accuracy. The release device includes a housing, a trigger, a keeper and a recoil assembly. This invention also relates to a method of using the release device.

19 Claims, 5 Drawing Sheets

RELEASE DEVICE WITH FOLLOW-THROUGH

BACKGROUND OF THE INVENTION

1. Field of the Invention

This invention relates to a release device with a follow-through or recoil motion, for use with mechanically launched projectiles.

2. Discussion of Related Art

Sear and caliper bowstring releases help a user in drawing and tensioning a bowstring. Bowstrings, especially ones used in performance archery equipment under high tension, can be difficult to draw and/or hold in a bare hand or a gloved hand. Wrist straps are attached to the bowstring release to provide a connection between the user and the bowstring release.

Conventional bowstring releases do not alter the form of the user and specifically do not provide a desired follow-though or recoil motion. Correct form and follow-through at the release of an arrow from a bow often includes a motion of a shooting hand that is opposite to a direction of a launched arrow. A follow-through motion can improve consistency and accuracy of the arrow or other projectile, particularly with respect to a target.

SUMMARY OF THE INVENTION

A release device according to this invention can meet a need for a bowstring release that provides a follow-through motion. The follow-through motion desirably occurs even if the user does not move a hand with the release of the arrow. This invention may include a release device with a housing and a trigger mechanism which actuates a keeper. The keeper may be located on the housing and can receive or engage a bowstring. The release device may include a recoil assembly coupled with the housing and movable in a direction opposite of a string travel or the projectile path. The recoil assembly may be adjustable and can include a spring member tensioned in a direction opposite of the string travel. The recoil assembly can move the housing, for example at least about 1 mm, opposite the direction of string travel.

The trigger mechanism is preferably but not necessarily adjustable. The keeper can include at least one pivotable jaw. Optionally, the release device includes a strap, such as a wrist strap, located on or connected to the recoil assembly.

According to another embodiment of this invention, the release device includes a housing, a trigger lever pivotably disposed on or mounted with respect to the housing and at least one pivotable jaw holding a string. The pivotable jaw is actuated by the trigger lever to provide a string release and/or travel. A recoil ferrule is slidably disposed on the housing by an anchor pin. A spring is mounted by the anchor pin within the recoil ferrule and is adjustably tensioned in a direction opposite of the string travel.

The release device may include a wrist strap disposed on the recoil ferrule. In some embodiments, the spring is helically coiled and/or held in position by the anchor pin with or without a cap screw.

This invention also relates to methods for using the release device. One method includes placing a nock of a projectile on a string, engaging a release device with the string, drawing tension on the string by pulling on the release device, and operating a trigger mechanism of the release device to disengage the string and launch the projectile while a recoil assembly substantially simultaneously moves a housing of the release device. The release device can move in a direction opposite of string travel.

The release device can be engaged with a holder or a loop. A shooting hand can remain stationary with respect to or along a direction of string travel. The method may also include moving a jaw or other structural element of the release device to an open position, such as when the trigger is operated or squeezed.

Other objects and advantages of this invention will be apparent to those skilled in the art from the following detailed description taken in conjunction with the appended claims and the drawings.

BRIEF DESCRIPTION OF THE DRAWINGS

The above and other objects of this invention can be better understood when the specification is read in view of the drawings, wherein.

DETAILED DESCRIPTION OF THE INVENTION

A shooting hand that moves directly opposite to the path of a launched arrow provides correct form and follow-through upon release of an arrow from a bow.

Figure 1:
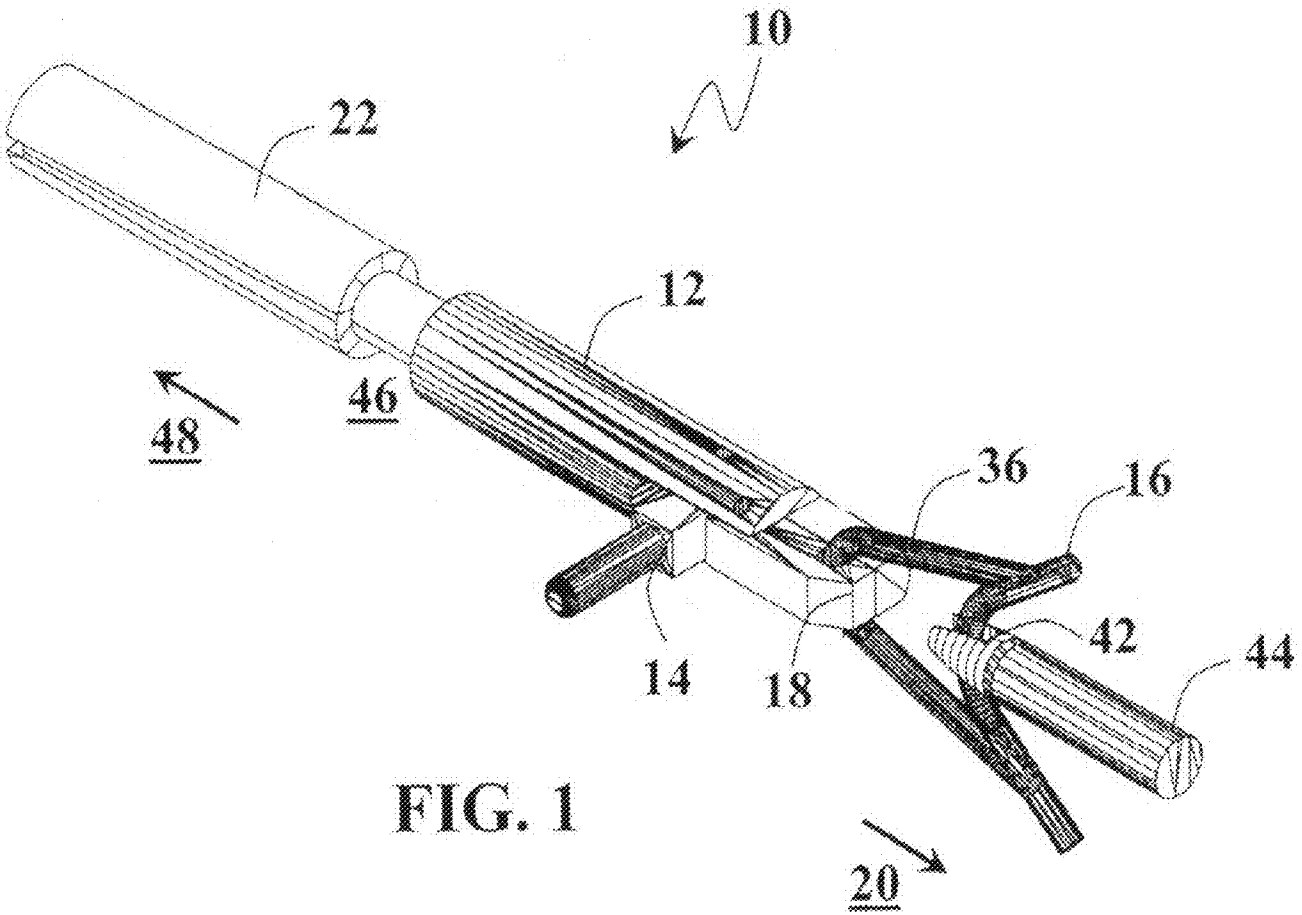
FIG. 1 is a perspective view of a release device, according to one embodiment of this invention.

FIG. 1 shows a perspective view of release device 10 according to this invention. Release device 10 may comprise housing 12, trigger mechanism 14, keeper 18 and recoil assembly 22. Release device 10 is generally known as a bowstring release, a string release device, a trigger release aid or any other suitable apparatus used to draw and launch arrows and other projectiles, such as by mechanical forces. Release device 10 may couple or connect a wrist, a hand, a shoulder or an arm of a user with a string or a cable to improve tensioning and/or releasing during launch of projectile 44. According to certain embodiments of this invention, release mechanism 10 connects to a wrist by an adjustable strap 28, such as a wrist strap.

Housing 12 may comprise a body, a plug, a cover, a frame and/or any other suitable structure for containing at least some components or parts of release device 10. Materials of construction for housing 12 include but are not limited to metals, plastics and/or any other suitable material sufficient to withstand forces required to operate or use release device 10. Manufacturing methods for housing 12 may include machining, casting, forging, boring and/or any other suitable shaping or forming processes. A weight or a mass of housing 12 may be minimized or reduced by using durable lightweight materials, such as aluminum alloys.

Trigger mechanism 14 may comprise an actuation switch, a launch button or an another suitable input device positioned, disposed or located on or with respect to housing 12. Trigger mechanism 14 can include a combination or a collection of pivots, pins, linkages, levers and/or any other suitable input transmitting or delivery couplings. Trigger mechanism 14 preferably has relatively few parts for reliable operation and/or low cost. Alternately, trigger mechanism 14 may have other features or functions, such as a lock, a safety lock, an interlock, an identification mechanism, an anti-theft device, a spring, a spring tensioning device, an adjusting mechanism, a trigger positioning device, an orientation adjusting device and/or any other desirable trigger mechanism.

Figure 2:
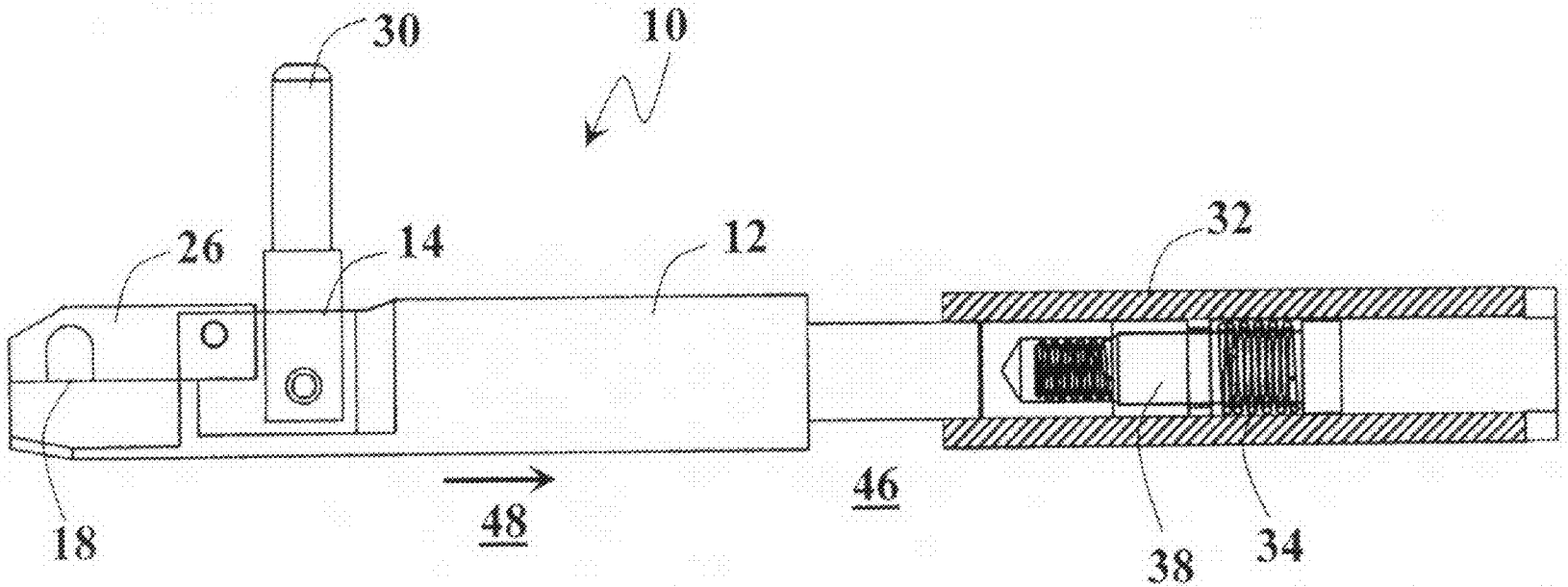
FIG. 2 is a partial sectional side view of a release device, according to one embodiment of this invention.
Figure 3:
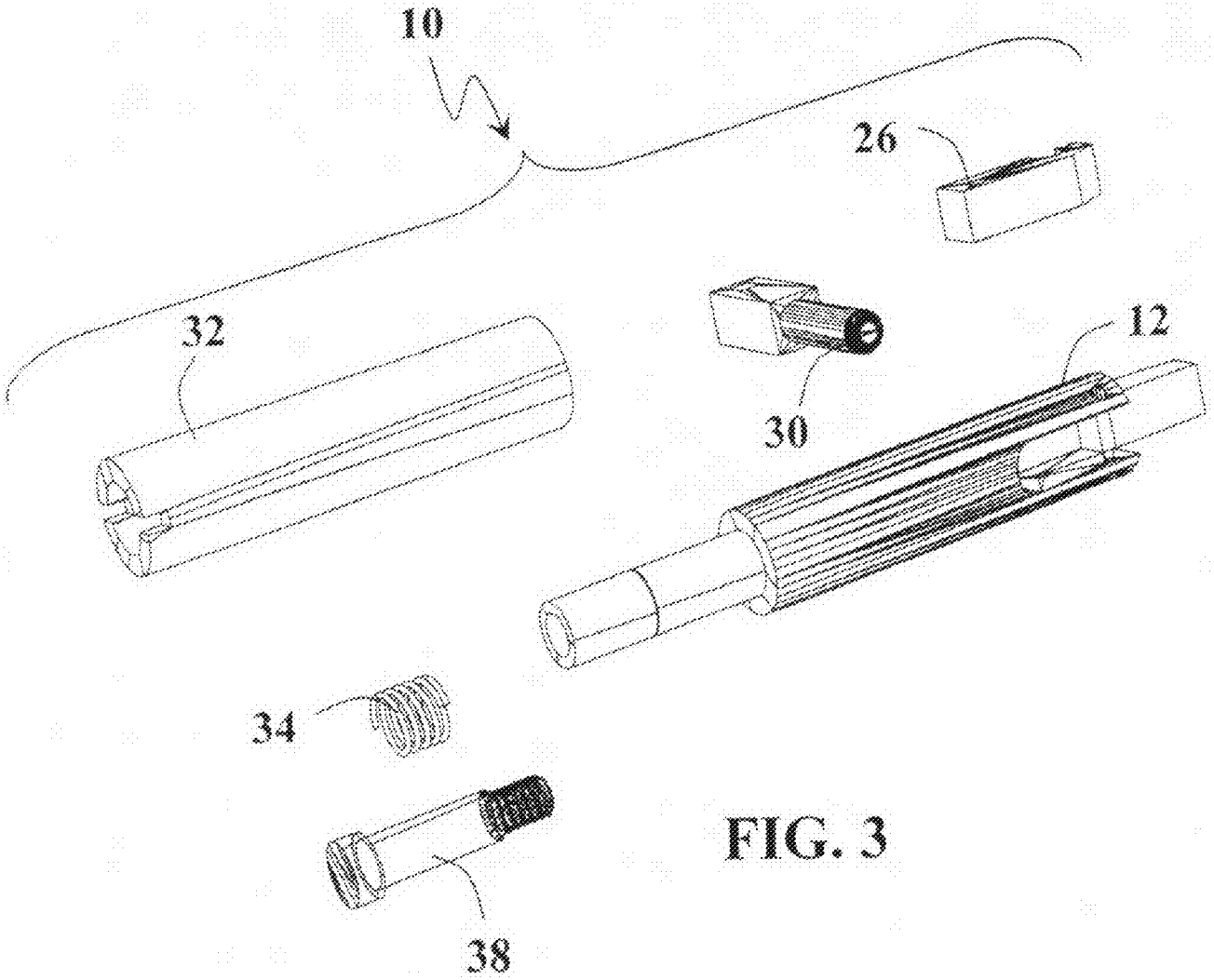
FIG. 3 is an exploded perspective view of a release device, according to one embodiment of this invention.

In certain embodiments of this invention and as shown in FIGS. 2 and 3, trigger mechanism 14 comprises trigger lever 30 which pivots on or with respect to housing 12. A pin, a dowel and/or a screw can move or actuate pivotable jaw 26. Trigger lever 30 can have a generally cylindrical shape, a contoured shape and/or any other suitable ergonomic form to facilitate or improve use and/or operation of release device 10. Trigger lever 30 can actuate in more than one direction, for example, in both a forward direction and a backward direction.

Figure 4:
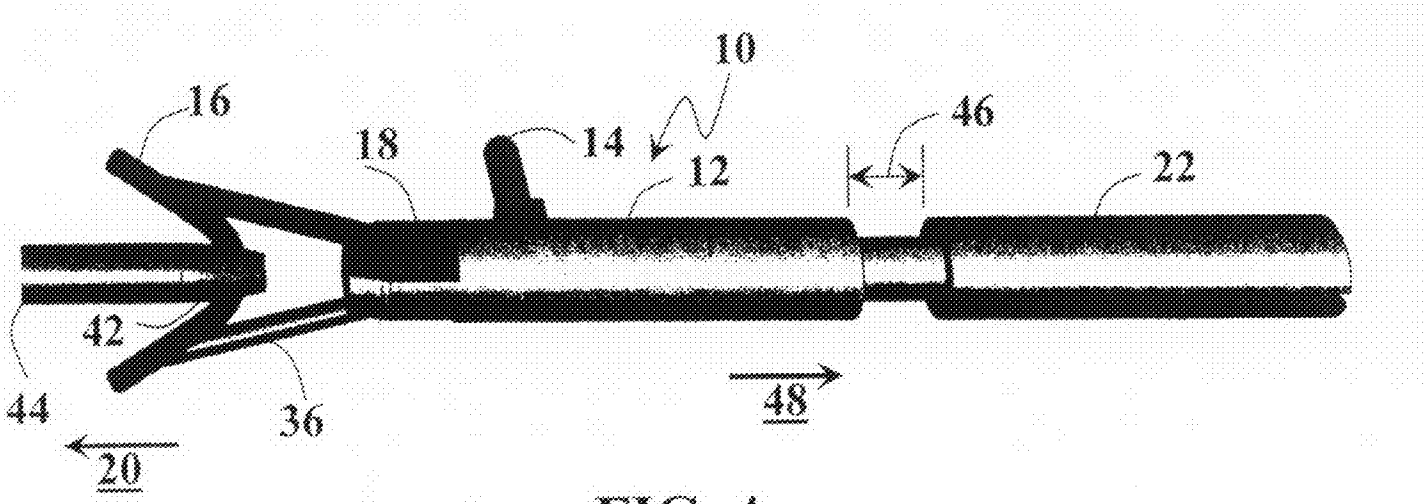
FIG. 4 is a side perspective view of a release device in a loaded position, according to one embodiment of this invention.
Figure 5:
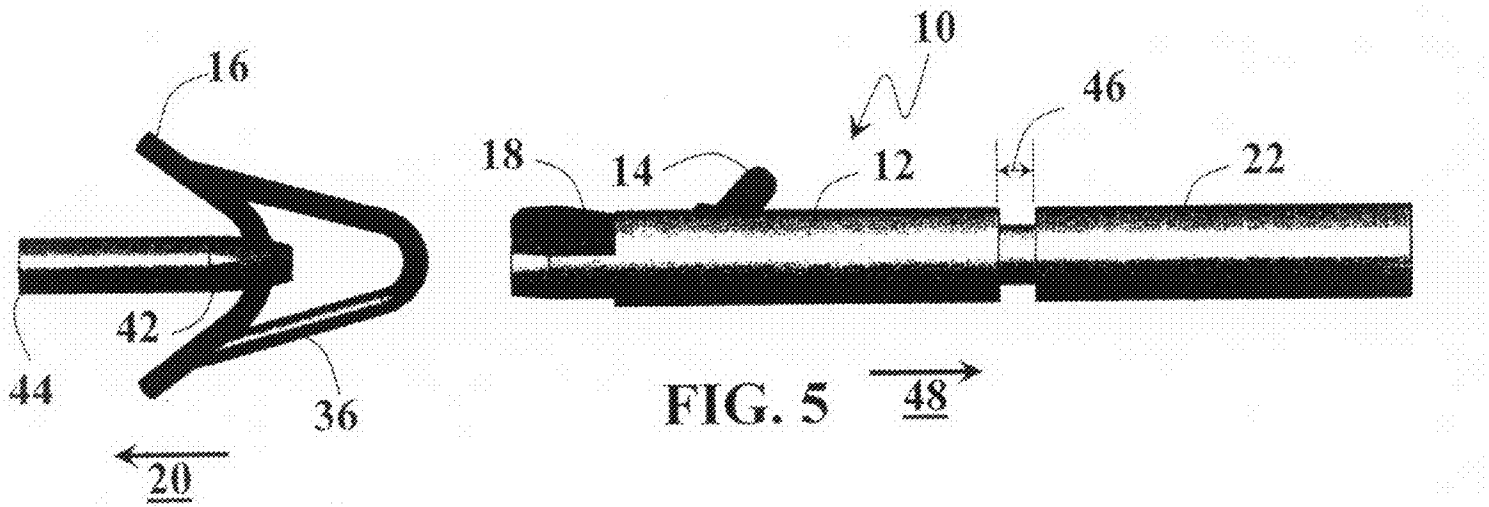
FIG. 5 is a side perspective view of the release device shown in FIG. 4, but in an unloaded position.

Keeper 18 can hold, clamp, grab, hook and/or provide any other suitable action to engage or connect with string 16. String 16 can include any suitable tensioning members or devices, such as a cord, a cable, a band, a rubber tube and/or any other suitable relatively inelastic or elastic, generally flexible linear material used for mechanically launching projectiles 44. According to certain embodiments of this invention and as shown in FIGS. 4 and 5, string 16 may include loop 36 which may allow release device 10 to engage string 16 without interfering or disturbing a coupling or an engagement of projectile 44 with string 16. Loop 36 may include any flexible and/or rigid substantially hoop-forming member, and can be an extension of string 16.

Projectiles 44 may comprise an arrow, a bolt, a pellet, a paint ball and/or any other suitable object or body typically used for hunting, target or range shooting, and the like, such as for any professional use, competitive use, recreational use and the like. Projectile 44 may comprise nock 42 for inserting, coupling and/or engaging string 16. An input force or a motive force can be applied to projectile 44 at nock 42.

String 16 may be tensioned by drawing or pulling string 16 in a direction substantially opposite or against a flight path or direction of projectile 44. Upon discharge, release or shooting, at least part of string 16 can travel or move in a direction of the discharged projectile 44 path which is shown in FIGS. 1, 2, 4 and 5, by string travel 20 and the associated directional arrow.

Keeper 18 may include a catch, a sear, a caliper, a hook, a jaw or any other suitable mechanical element, device or configuration for engaging string 16. According to certain embodiments of this invention, keeper 18 comprises at least one pivoting jaw 26 that cooperates with stationary jaw 24 on housing 12 to engage string 16, which can provide a simple and reliable design. In other embodiments, keeper 18 may comprise more than one moving element, such as similar to a pliers having two sears pivotably or hingedly connected together. Keeper 18 may comprise combinations or configurations of springs, pivots, linkages, plungers and/or other suitable components needed to provide additional features or functions as desired. Keeper 18 may be mounted or disposed on housing 12 and actuated or released by trigger mechanism 14. Keeper 18 can normally form an open or a released position or state, a closed or locked position or state or any other suitable intermediate position or state.

Recoil assembly 22 may provide a follow-through motion or recoil action which is generally in an opposite or a reverse direction of string travel 20 and projectile 44 path. In certain embodiments of this invention and as shown in FIGS. 1, 2, 4 and 5, recoil direction 48 and the associated directional arrow is a vector or force approximately 180 degrees with respect to a direction of string travel 20.

Recoil assembly 22 may provide a follow-through motion upon release of string 16 and/or launch of projectile 44. Adequate follow-through motion can improve consistency and/or accuracy of projectile 44 with respect to a target. Aiming or shooting accuracy and consistency can be achieved with the apparatus and the method of this invention.

Recoil assembly 22 moves housing 12 in recoil direction 48, for example, by about at least 1 mm, by about 2 mm to about 8 mm, or by about 4.7 mm. The follow-through motion is illustrated by recoil distance 46 in FIG. 4 before a launch, and in FIG. 5 after a launch. Recoil distance 46 may be equal to a distance between housing 12 and recoil assembly 22, such as shown in FIGS. 4 and 5.

Recoil assembly 22 may comprise a tensioning device or a spring member to impart or generate the follow-through motion. Recoil assembly 22 can be coupled with housing 12, slidably, pivotably and/or by any other suitable arrangement or configuration that allows recoil assembly 22 to impart or generate follow-through motion to or within housing 12.

In certain embodiments of this invention and as shown in FIGS. 2 and 3, recoil assembly 22 comprises recoil ferrule 32, spring 34 and anchor pin 38. Recoil ferrule 32 may be of a substantially similar size to housing 12 and may be slidably or movably mounted on or with respect to housing 12. Recoil ferrule 32 can have a generally hollow design for housing or containing spring 34 and/or anchor pin 38. According to certain embodiments of this invention, recoil ferrule 32 can be constructed of the same or different materials as housing 12.

Recoil assembly 22 may be adjustable for increasing and/or decreasing recoil distance 46 and thus spring 34 tension. Suitable adjustment mechanisms include threaded connections, pinned holes, and any other suitable adjustment device used to adjust the tension of spring 34 and/or any other bias element.

According to certain embodiments of this invention and as shown in FIG. 3, spring 34 may comprise a generally helical configuration and is suitably adapted to provide compressive resilience when biased, tensioned and/or loaded. Alternately, spring 34 comprises an elastomer or elastomeric plug of material, such as a polymer rubber.

Anchor pin 38 can be positioned by friction, interference fit, adhesive, threads and/or any other suitable joining method. According to certain embodiments of this invention, such as shown in FIG. 3, anchor pin 38 may comprise a cap screw. Anchor pin 38 can mount or affix spring 34 in a suitable position within housing 12 or recoil assembly 22.

Recoil assembly 22 may cooperatively act or respond to and/or with trigger mechanism 14. For example, recoil assembly 22 has a separately loadable mechanism that is tensioned prior to drawing or loading a projectile 44 and that can be released upon operating trigger lever 30.

Figure 6:
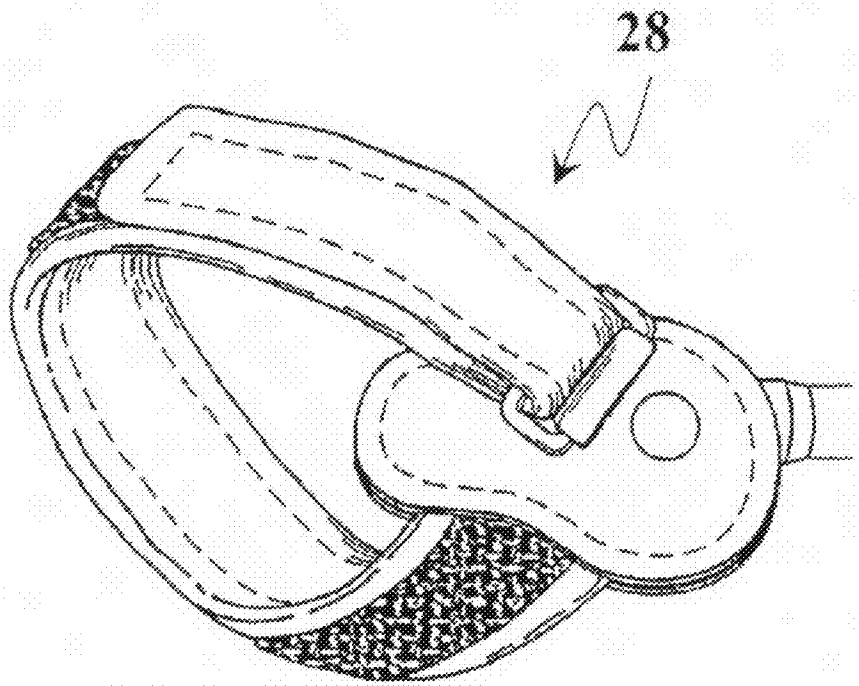
FIG. 6 is a side perspective view of a wrist strap, according to one embodiment of this invention.

Strap 28, such as a wrist strap, may include leather, nylon and/or any other suitable material for looping about a wrist, a forearm, a shoulder or a hand of a user. Strap 28 may include one or more sizing or cinching mechanisms, such as hook and loop fasteners, belts and/or buckles to improve a fit and/or a use by the shooter. Strap 28 may connect with or mount on recoil assembly 22. According to certain embodiments of this invention, such as shown in FIG. 6, strap 28 may be adapted to a right-handed user. Alternate straps 28 may be adapted to a left-handed user.

This invention also relates to methods of use for release device 10. In certain embodiments, nock 42 of projectile 44 is positioned on string 16. Release device 10 engages string 16 and tension is applied to string 16 by pulling on release device 10. Trigger mechanism 14 operates to disengage string 16 and launch or discharge projectile 44 while recoil assembly 22 substantially simultaneously moves housing 12 of release device 10, such as in recoil direction 48 generally opposite of a direction of string travel 20.

In other embodiments of the method for using release device 10, release device 10 is engaged with loop 36. In some embodiments, recoil distance 46 is at least 1 mm in recoil direction 48, opposite of string travel 20. An operator hand can remain stationary with respect to a direction of string travel 20 during projectile 44 launch. At least one jaw 26 of release device 10 can move to an open position when trigger lever 30 is operated.

In some embodiments of this invention, the user or shooter places strap 28 on a left wrist and strap 28 is tethered to release device 10. The user picks up an arrow with the left hand while holding the bow in a right hand and then engages nock 42 with string loop 36. The shooter engages release device 10 with string 16 by placing pivotable jaw 26 over sting 16. The shooter tensions the bow by drawing back the left hand and aiming the arrow at a target. As the user draws string 16 taut by pulling the arm and wrist back, keeper 18 is held in a closed position by the tension and recoil assembly 22 moves to an extended position as spring 34 is tensioned by the same step. The user then pulls trigger mechanism 14 to move keeper 18 into an open position. At substantially the same time, string 16 moves in a direction of the arrow path to provide a discharge force and in the opposite direction recoil assembly 22 provides follow-through motion. The user may then repeat steps as desired.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

What is claimed is:

1. A release device for a bow string comprising:

a housing, a trigger movably mounted with respect to the housing;

a keeper mounted with respect to the housing and actuated by the trigger to release the bow string; and a recoil assembly mounted with respect to the housing and upon release of the bow string the recoil assembly moving a recoil distance with respect to the housing opposite a direction of travel of the released bow string, the recoil assembly comprising a spring mounted within the housing, and the spring being biased in a bias direction that is opposite of the direction of travel.

2. The device of claim 1, wherein the bias force of the recoil assembly is adjustable.

3. The device of claim 1, wherein a movement of the trigger is adjustable.

4. The device of claim 1, wherein the keeper comprises at least one jaw pivotably mounted with respect to the housing.

5. The device of claim 1, wherein the keeper receives the bow string.

6. A release device for a bow string comprising:

a housing, a trigger movably mounted with respect to the housing;

a keeper mounted with respect to the housing and actuated by the trigger to release the bow string; and a recoil assembly mounted with respect to the housing and upon release of the bow string the recoil assembly moving a recoil distance with respect to the housing opposite a direction of travel of the released bow string, and upon release of the bow string the recoil assembly moving the housing opposite of the direction of travel.

7. The device of claim 6, wherein the recoil assembly comprises a spring mounted within the housing.

8. The device of claim 7, wherein the spring is biased in a bias direction that is opposite of the direction of travel.

9. A release device for a bow string comprising:

a housing, a trigger movably mounted with respect to the housing:

a keeper mounted with respect to the housing and actuated by the trigger to release the bow string; and a recoil assembly mounted with respect to the housing and upon release of the bow string the recoil assembly moving a recoil distance with respect to the housing opposite a direction of travel of the released bow string, and a strap attached to the recoil assembly.

10. A release device for a bow string comprising:

a housing, a trigger pivotably mounted with respect to the housing;

at least one jaw pivotably mounted with respect to the housing for holding the bow string, the trigger actuating the at least one jaw to release the bow string;

a recoil ferrule slidably mounted with respect to the housing; and a spring mounted with respect to an anchor pin within the recoil ferrule, the spring biased in a bias direction opposite of a direction of travel of the bowstring when released, and the spring moving the recoil assembly a recoil distance with respect to the housing.

11. The release device of claim 10, further comprising a strap attached to the recoil ferrule.

12. The release device of claim 10, wherein the spring is helically coiled.

13. The release device of claim 10, wherein the recoil ferrule moves the housing at least about 1 mm opposite of the direction of travel.

14. The release device of claim 10, wherein the anchor pin comprises a cap screw.

15. A method of using a release device for a bow string, the method comprising:

placing a nock of a projectile on the bow string;

engaging a release device with the bow string;

pulling on the release device to tension the bow string; and squeezing a trigger of the release device to disengage the bow string and launch the projectile while a recoil assembly moves a recoil assembly a recoil distance with respect to a housing of the release device and in a direction opposite of a string travel of the bow string, and as the bow string is released the housing moving along the direction of the string travel.

16. The method of claim 15, wherein the release device is engaged with a loop of material.

17. The method of claim 15, wherein a recoil distance is at least about 1 mm in a direction opposite of the string travel.

18. The method of claim 15, wherein at least one jaw of the release device moves to an open position when the trigger is operated.

19. A method of using a release device for a bow string, the method comprising:

placing a nock of a projectile on the bow string;

engaging a release device with the bow string;

pulling on the release device to tension the bow string: and squeezing a trigger of the release device to disengage the bow string and launch the projectile while a recoil assembly moves a recoil assembly a recoil distance with respect to a housing of the release device and in a direction opposite of a string travel of the bow string, and a strap connected to the recoil assembly.

* * * * *